US006564493B1

(12) United States Patent
Forman

(10) Patent No.: US 6,564,493 B1
(45) Date of Patent: May 20, 2003

(54) RECOIL PROTECTION DEVICE

(76) Inventor: Max R. Forman, 46 Field Road Fox Lane, Farnborough, Hampshire (GB), GU14 9DL ( * ) Notice: Subject to any disclaimer, the term of this patent is extended or adjusted under 35 U.S.C. 154(b) by 0 days.

(21) Appl. No.: 10/270,455

(22) Filed: Oct. 15, 2002

(51) Int. Cl.[7] ..... F41C 23/08
(52) U.S. Cl. ..... 42/74
(58) Field of Search ..... 42/74, 1.06, 71.01, 42/90

(56) References Cited

U.S. PATENT DOCUMENTS

| | | | | | |
|---|---|---|---|---|---|
| 3,604,138 | A | * | 9/1971 | Wilson | 42/74 |
| 4,316,342 | A | | 2/1982 | Griggs | 42/74 |
| 4,439,943 | A | | 4/1984 | Brakhage | 42/74 |
| 5,001,855 | A | | 3/1991 | Griggs | 42/74 |
| 5,375,360 | A | * | 12/1994 | Vatterott | 42/74 |
| 5,410,833 | A | | 5/1995 | Paterson | 42/74 |
| 5,979,098 | A | | 11/1999 | Griggs | 42/74 |
| D449,668 | S | | 10/2001 | Gangl, Jr. | D22/11 |
| 6,467,212 | B1 | * | 10/2002 | Apel | 42/74 |
| 2001/0011434 | A1 | * | 8/2001 | Gussalli Beretta | 42/74 |

* cited by examiner

*Primary Examiner*—J. Woodrow Eldred

(57) ABSTRACT

A recoil protection device for absorbing the shock of a gun includes a device that is removably attachable to the end of a gunstock. The device comprises a base plate releasably secured to the end of the gunstock. A substantially rigid panel has a pair of spaced holes extending therethrough. A pair of mounts is attached to and extends away from the base plate. Each of the mounts is positioned such that each extends through one of the holes in the panel. A shock absorber is mechanically coupled to the panel and to each of the mounts. The shock absorber is compressed along a line, which is substantially co-planar with a plane of the base plate. A covering is attached to a peripheral edge of the panel and extends over a side of the panel opposite of the base plate.

6 Claims, 2 Drawing Sheets

RECOIL PROTECTION DEVICE

BACKGROUND OF THE INVENTION

1. Field of the Invention

The present invention relates to recoil cushioning devices and more particularly pertains to a new recoil cushioning device for rifle and shotgun applications that would make use of a gas-charged strut to substantially reduce the kick-back from the butt of a gunstock.

2. Description of the Prior Art

The use of recoil cushioning devices is known in the prior art. U.S. Pat. No. 5,979,098 describes a recoil absorber and redirector mechanism for a gunstock. Another type of recoil cushioning devices is U.S. Pat. No. 5,001,855 describes an adjustable mounting device for recoil absorbers and redirect mechanisms. U.S. Pat. No. 4,316,342 describes a recoil absorber and redirector mechanism for a gunstock. U.S. Pat. No. 5,410,833 describes a recoil absorbing firearm stock. U.S. Pat. No. 4,439,943 describes a recoil reducer. U.S. Pat. No. Des. 449,668 describes an ornamental design for a recoil reducer for firearms.

SUMMARY OF THE INVENTION

The object of the present invention is to provide a new recoil cushioning device that would reduce the pain and bruising associated with shooting high-energy ammunition.

Another object of the present invention is to provide a new recoil cushioning devices that would improve the shooter's accuracy by giving the shooter more physical control over the weapon.

To this end, the present invention generally comprises a recoil absorption device for a gun. The device is removably attachable to the end of a gunstock. The device comprises a base plate releasably secured to the end of the gunstock. A substantially rigid panel has a pair of spaced holes extending therethrough. A pair of mounts is attached to and extends away from the base plate. Each of the mounts is positioned such that each extends through one of the holes in the panel. A shock absorber is mechanically coupled to the panel and to each of the mounts. The shock absorber is compressed along a line, which is substantially co-planar with a plane of the base plate. A covering is attached to a peripheral edge of the panel and extends over a side of the panel opposite of the base plate.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty, which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
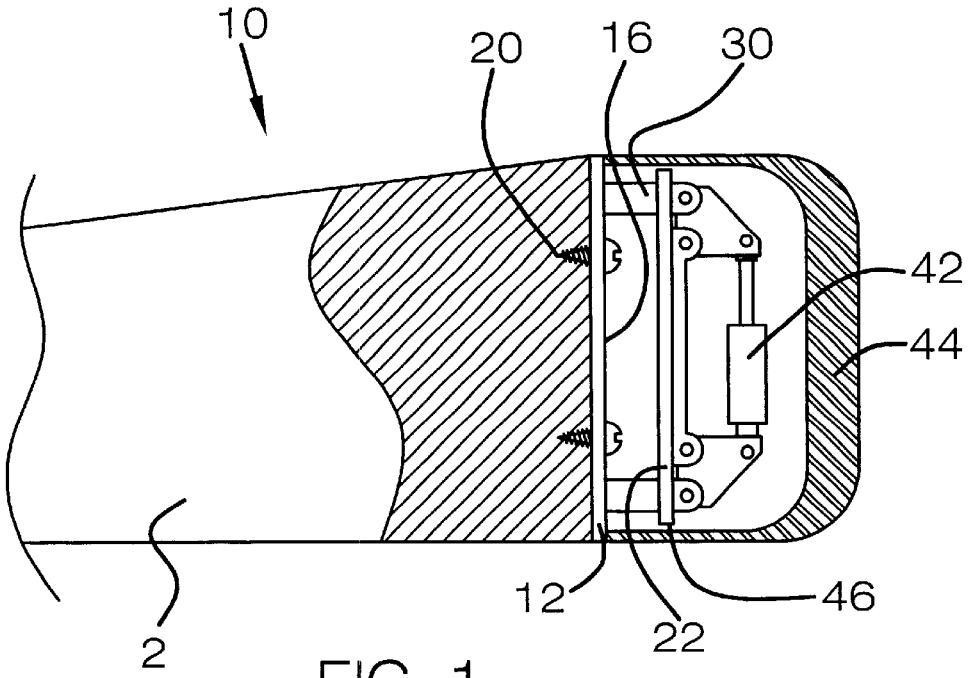
FIG. 1 is a side view of a recoil protection device according to the present invention.
Figure 2:
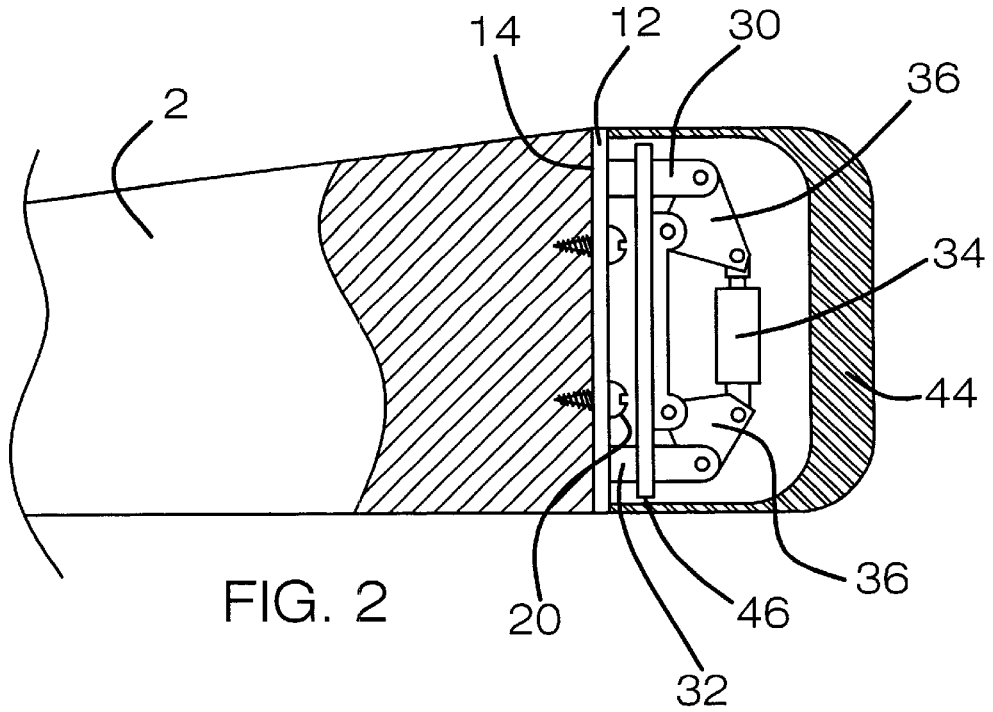
FIG. 2 is a side view of the present invention.
Figure 3:
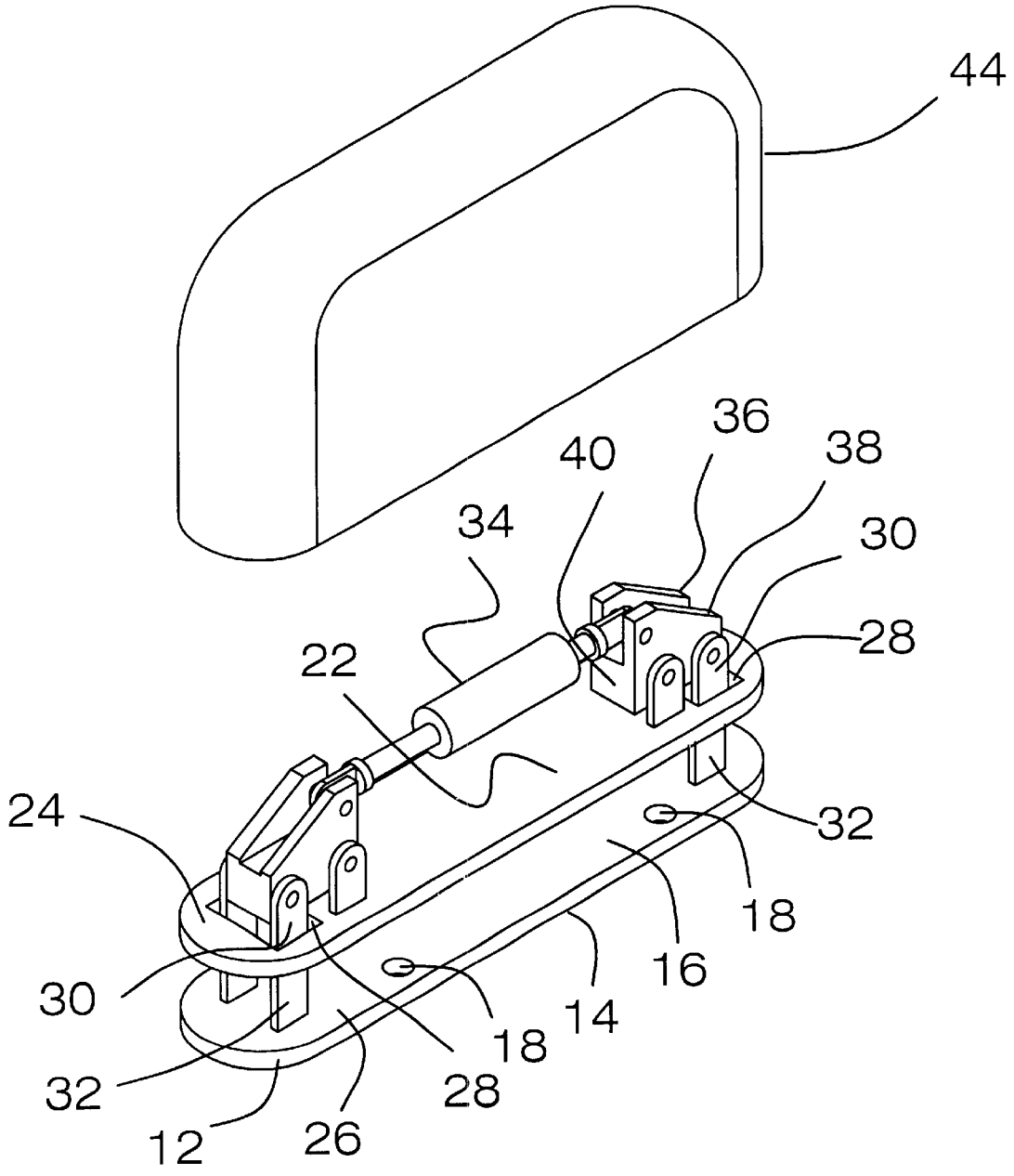
FIG. 3 is a perspective view of the present invention.

With reference now to the drawings, and in particular to FIGS. 1 through 3 thereof, a new recoil cushioning devices embodying the principles and concepts of the present invention and generally designated by the reference numeral 10 will be described.

As best illustrated in FIGS. 1 through 3, the recoil protection device 10 generally comprises a recoil absorption device 10 for a gun. The device 10 is removably attachable to the end of a gunstock 2. The device 10 comprises a base plate 12 having a first side 14 and a second side 16. The base plate 12 has a plurality of openings 18 extending therethrough. A plurality of securing members 20 releasably secures the base plate 12 to the end of the gunstock 2 such that the first side 14 is abutting the gunstock 2. Each of the securing members 20 is removably extended through one of the openings 18 and into the gunstock 2. The securing members 20 preferably comprise screws, though, alternatively, the base plate 12 may be attached to the gunstock by other mechanical means or by an adhesive.

A panel 22 has an inner surface 24 and an outer surface 26. The panel 22 is substantially rigid. The panel 22 has a pair of holes 28 extending therethrough which are spaced from each other. Each of a pair of mounts 30 is attached to and extends away from the second side of the base plate 12. Each of the mounts 30 is positioned such that each extends through one of the holes 28 in the panel 22 and the outer surface 26 of the panel 22 faces the base plate 12. The mounts 30 each preferably comprise a pair of legs 32.

A shock absorber 34 is mechanically coupled to the inner surface 24 of the panel 22 and to each of the mounts 30. The shock absorber 34 is compressed along a line, which is substantially co-planar with the second side of the base plate 12. The shock absorber 34 includes a pair of pivots 36. The pivots 36 have first portion 38 pivotally coupled to one of the mounts 30 and a second portion 40 pivotally coupled to the inner surface 24. The second portions 40 are positioned between the holes 28. A pneumatic shock 42 extends between and is pivotally coupled to each of the pivots 36. Alternatively, a hydraulic shock may be used. The first portions 38 are moved upwardly away from the inner surface 24 when the outer surface is moved toward the base plate 12.

A covering 44 is attached to a peripheral edge 46 of the panel 22. The covering 44 extends over the shock absorber 34. The covering comprises a cushioning material, which is preferably an elastomeric material.

In use, the base plate 12 is attached to the end of the gunstock 2. When the gun is fired, the recoil of the gun forces the base plate 12 toward the panel 22. The shock absorber 34 resists this by biasing the first portions 38 of the pivots 36 downward and thus absorbs a portion of the recoil before it can reach the user's shoulder. After the recoil of the gun, the shock absorber 34 causes the panel 22 to move away from the base plate 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A recoil absorption device for a gun, said device being removably attachable to the end of a gunstock, said device comprising:

a base plate releasably secured to the end of the gunstock;

a substantially rigid panel having a pair of spaced holes extending therethrough;

a pair of mounts being attached to and extending away from said base plate, each of said mounts being positioned such that each extends through one of said holes in said panel;

a shock absorber being mechanically coupled to said panel and to each of said mounts, wherein said shock absorber is compressed along a line which is substantially co-planar with a plane of said base plate; and a covering being attached to a peripheral edge of said panel and extending over a side of said panel opposite of said base plate.

2. A recoil absorption device for a gun, said device being removably attachable to the end of a gunstock, said device comprising:

a base plate having a first side and a second, said first side of said base plate being releasably secured to the end of the gunstock;

a panel having an inner surface and an outer surface, said panel being substantially rigid, said panel having a pair of holes extending therethrough, said holes being spaced from each other;

a pair of mounts being attached to and extending away from said second side of said base plate, each of said mounts being positioned such that each extends through one of said holes in said panel such that said outer surface of said panel faces said base plate;

a shock absorber being mechanically coupled to said inner surface of said panel and to each of said mounts, wherein said shock absorber is compressed along a line which is substantially co-planar with said second side of said base plate; and a covering being attached to a peripheral edge of said panel, said covering extending over said shock absorber.

3. The recoil absorption device as in claim 2, wherein said base plate has a plurality of openings extending therethrough, a plurality of securing members for releasably securing said base plate to the end of the gunstock such that said first side is abutting the gunstock, each of said securing members being removably extended through one of said openings and into the gunstock.

4. The recoil absorption device as in claim 2, wherein said shock absorber includes a pair of pivots, each of said pivots having first portion pivotally coupled to one of said mounts and a second portion pivotally coupled to said inner surface, said second portions being positioned between said holes, a pneumatic shock extending between and being pivotally coupled to each of said pivots, wherein said first portions are moved upwardly away from said inner surface when said outer surface is moved toward said base plate.

5. The recoil absorption device as in claim 2, wherein said covering comprises a cushioning material.

6. A recoil absorption device for a gun, said device being removably attachable to the end of a gunstock, said device comprising:

a base plate having a first side and a second side, said base plate having a plurality of openings extending therethrough;

a plurality of securing members for releasably securing said base plate to the end of the gunstock such that said first side is abutting the gunstock, each of said securing members being removably extended through one of said openings and into the gunstock, each of said securing members comprising a screw;

a panel having an inner surface and an outer surface, said panel being substantially rigid, said panel having a pair of holes extending therethrough, said holes being spaced from each other;

a pair of mounts being attached to and extending away from said second side of said base plate, each of said mounts being positioned such that each extends through one of said holes in said panel such that said outer surface of said panel faces said base plate, each of said mounts comprising a pair of legs;

a shock absorber being mechanically coupled to said inner surface of said panel and to each of said mounts, wherein said shock absorber is compressed along a line which is substantially co-planar with said second side of said base plate, said shock absorber including a pair of pivots, each of said pivots having first portion pivotally coupled to one of said mounts and a second portion pivotally coupled to said inner surface, said second portions being positioned between said holes, a pneumatic shock extending between and being pivotally coupled to each of said pivots, wherein said first portions are moved upwardly away from said inner surface when said outer surface is moved toward said base plate; and a covering being attached to a peripheral edge of said panel, said covering extending over said shock absorber, said covering comprising a cushioning material, said cushioning material comprising an elastomeric material.

* * * * *